US006395444B1

(12) United States Patent
Riehle et al.

(10) Patent No.: US 6,395,444 B1
(45) Date of Patent: May 28, 2002

(54) FUSER MEMBERS HAVING INCREASED THERMAL CONDUCTIVITY AND METHODS OF MAKING FUSER MEMBERS

(75) Inventors: George A. Riehle, Webster; Laurence J. Lynd, Macedon; Mark S. Amico, Rochester, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/722,645

(22) Filed: Nov. 28, 2000

(51) Int. Cl.[7] ..... G03G 13/20

(52) U.S. Cl. ..... 430/124; 399/320; 399/333; 399/335

(58) Field of Search ..... 430/124; 399/320, 399/333, 335

(56) References Cited

U.S. PATENT DOCUMENTS 4,257,699 A 3/1981 Lentz
5,017,432 A 5/1991 Eddy et al.
5,061,965 A 10/1991 Ferguson et al.
5,166,031 A 11/1992 Badesha et al.
5,281,506 A 1/1994 Badesha et al.
5,337,129 A 8/1994 Badesha
5,366,772 A 11/1994 Badesha et al.
5,370,931 A 12/1994 Fratangelo et al.
5,486,987 A 1/1996 Fritz, Jr.
6,002,910 A 12/1999 Eddy et al.
6,007,657 A 12/1999 Eddy et al.

*Primary Examiner*—Mark Chapman
(74) *Attorney, Agent, or Firm*—Oliff & Berridge, PLC

(57) ABSTRACT

Fuser members having improved thermal conductivity include an outer layer composed of elastomers and filler materials. The filler materials are oriented in the outer layer to provide directional thermal conductivity. Processes for forming the fuser members apply a liquid coating over a substrate and apply a magnetic field to the coating to orient the filler material. The coating is cured to retain the orientation of the filler material in the outer layer.

24 Claims, 5 Drawing Sheets

FUSER MEMBERS HAVING INCREASED THERMAL CONDUCTIVITY AND METHODS OF MAKING FUSER MEMBERS

BACKGROUND OF THE INVENTION 1. Field of Invention

This invention relates to fuser members for fusing toner images in imaging apparatus. This invention also relates to methods of making the fuser members. 2. Description of Related Art In electrostatographic imaging apparatus, a light or digital image of an original to be copied is recorded as an electrostatic latent image on a photosensitive member and the latent image is subsequently rendered visible by the application of toner to the photosensitive member. The toner image is then fixed or fused upon a support. The support can be, for example, the photosensitive member itself or a support sheet, such as paper.

Thermal energy is generally used to fix toner images onto support members. To permanently fuse toner material onto a support surface by the application of heat, the toner material is heated to cause the toner to flow into the support member. During cooling of the toner material, it solidifies and becomes firmly bonded to the support.

SUMMARY OF THE INVENTION

Fillers have been added to outer (fusing) layers in fuser members for electrostatographic imaging apparatus to increase the thermal conductivity of these layers. See, for example, U.S. Pat. Nos. 6,002,910 and 6,007,657, which are each incorporated herein by reference in their entirety. By increasing thermal conductivity of the outer layers, the temperature needed to promote fusion of toner to supports is reduced. In addition, energy consumption is reduced. Increasing the thermal conductivity of outer layers also increases the speed of the fusing process by reducing the amount of time needed to heat the fuser member to a sufficient temperature to promote fusing.

Although fillers have been added to outer layers in fuser members to increase thermal conductivity, adding increasing amounts of filler also increases the hardness of the outer layer. Accordingly, for uses of fuser members in which excessive hardness of the outer layer is undesirable, the amount of filler added to the outer layer needs to be controlled to achieve the desired thermal conductivity of the outer layer, but without overly increasing hardness of the outer layer.

This invention provides fuser members having increased thermal conductivity.

This invention also provides fuser members having increased thermal conductivity and also desirable hardness.

This invention further provides fuser members having an outer layer that increases fusing speed. The fuser members also allow the use of reduced fusing temperatures at normal fusing speeds.

This invention also provides methods of making improved fuser members.

Exemplary embodiments of fuser members according to this invention comprise a substrate and an outer layer over the substrate. The outer layer comprises an elastomer and a filler material. The filler material comprises at least one ferromagnetic material and/or paramagnetic material. The filler material is anisotropically oriented in the outer layer. The outer layer has increased thermal conductivity in at least one direction as compared to outer layers comprising a filler material that is non-oriented, or randomly oriented.

Exemplary embodiments of methods of forming fuser members according to this invention comprise applying a liquid coating material over a substrate. The coating material comprises an elastomer and a filler material. The filler material comprises at least one ferromagnetic material and/or paramagnetic material. The coating material may optionally comprise a solvent. A magnetic field is applied to the coating material to orient the filler material in a selected orientation in the coating material. The coating material is cured with the filler material in the selected orientation to form an outer layer over the substrate, such that the filler material is oriented substantially in the selected orientation in the outer layer. The outer layer has increased thermal conductivity in at least one direction.

DETAILED DESCRIPTION OF PREFERRED EMBODIMENTS

Figure 1:
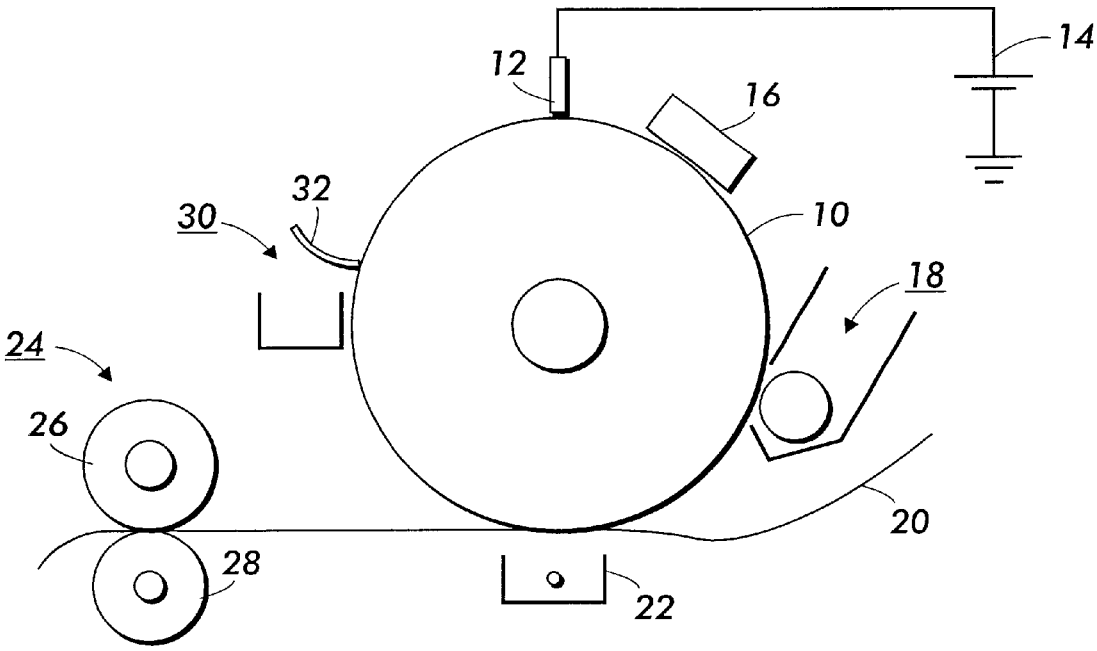
FIG. 1 illustrates an electrostatographic imaging apparatus comprising an exemplary embodiment of a fuser member in the form of a fuser roll according to this invention.

FIG. 1 illustrates a typical electrostatographic imaging apparatus. A light image of an original to be copied is recorded as an electrostatic latent image on a photosensitive member, such as a photoreceptor 10. The latent image is rendered visible by the application of toner to the photoreceptor 10. Specifically, photoreceptor 10 is charged on its surface by a charger 12 to which a voltage has been supplied from power supply 14. The photoreceptor 10 is then exposed to light emitted by a light source 16 to form an electrostatic latent image on the photoreceptor 10. Alternatively, as is known in the art, the latent image can be digitally formed on the photoreceptor 10. The electrostatic latent image is developed with toner at a development station 18.

After the toner particles have been deposited on the photoreceptor 10, in image configuration, they are transferred to a copy sheet 20 by a transfer device 22. The transfer process can be, for example, a pressure transfer or electrostatic transfer process. Alternatively, the developed image can be transferred to an intermediate transfer member and subsequently transferred to a copy sheet.

After the transfer of the developed image is completed, copy sheet 20 advances to a fusing station 24 including a fuser member and a pressure member. In this embodiment, the fuser member and pressure member comprise a fuser roll 26 and a pressure roll 28. At the fusing station 24, the developed image is fused to copy sheet 20 by passing the copy sheet 20 between the fusing roll 26 and the pressure member 28, thereby forming a permanent image. The photoreceptor 10 is then advanced to a cleaning station 30. The cleaning station 30 cleans the photoreceptor 10 to remove residual toner from the photoreceptor 10 by use of a cleaning device, such as blade 32.

Figure 2:
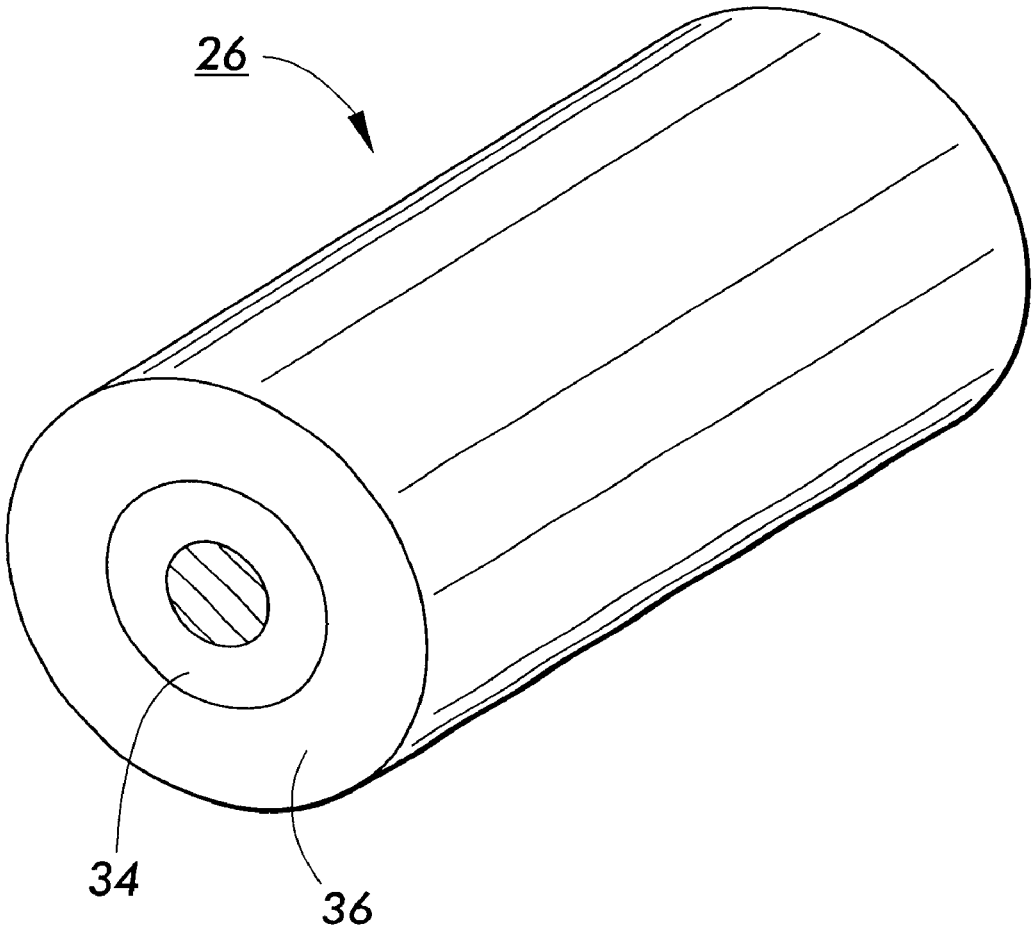
FIG. 2 is an end view of an exemplary fuser roll according to this invention.

FIG. 2 illustrates an exemplary embodiment of a fuser roll 26 according to this invention comprising a substrate 34, and an outer layer 36 formed over the substrate 34.

In some embodiments, a heating element is disposed in the hollow portion of the substrate 34 of the fuser roll 26. In other embodiments, the heating element is located external to the fuser member. Optionally, both external and internal heating elements can be used in embodiments of the fuser member.

The fuser roll 26 can optionally also include an adhesive layer, cushion layer, or other suitable layer positioned between the substrate 34 and the outer layer 36.

Furthermore, in some embodiments, one or more optional layers can be formed over the outer layer 36. In such embodiments, the optional layers are referred to as outermost layers.

Figure 3:
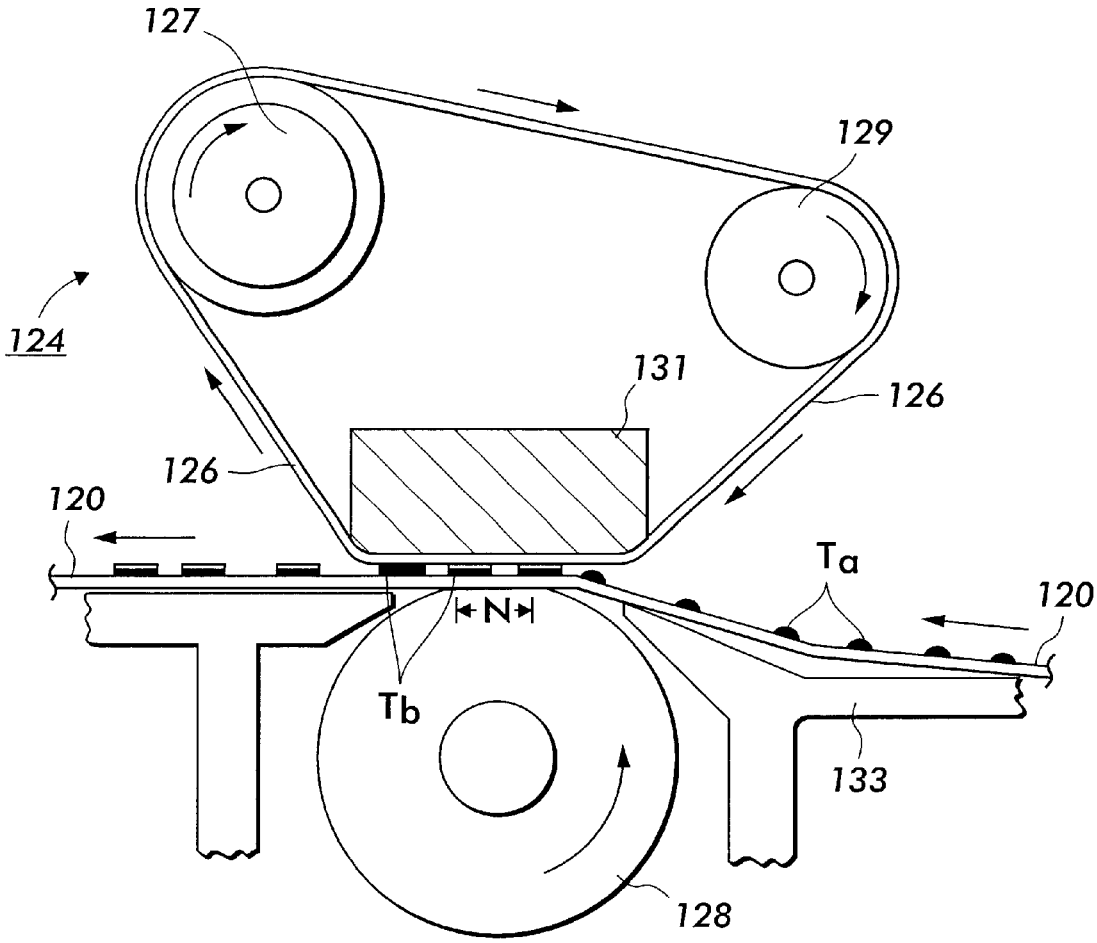
FIG. 3 illustrates a fusing station of an electrostatographic imaging apparatus comprising an exemplary embodiment of a fuser belt according to this invention.

FIG. 3 illustrates a fusing station 124 of an electrostatographic imaging apparatus including another exemplary embodiment of a fuser member according to this invention. The fuser member comprises a fuser belt 126. The fusing station 124 also comprises a pressure roller 128. The fuser belt 126 extends around a driving roller 127, a follower roller 129 and a heater 131 disposed between the driving roller 127 and follower roller 129. The fuser belt 126 rotates in the clockwise direction as depicted by arrows.

An unfixed toner image is formed on a copy sheet 120 at the image forming station. The copy sheet 120 having an unfixed toner image Ta is guided by a guide 133 to enter between the fuser belt 126 and the pressure roller 128 at the nip N defined by the heater 131 and pressure roller 128. The copy sheet 120 passes through the nip N together with the fuser belt 126. The toner image is heated at the nip N such that it is softened and fused into a softened or fused image Tb.

Figure 4:
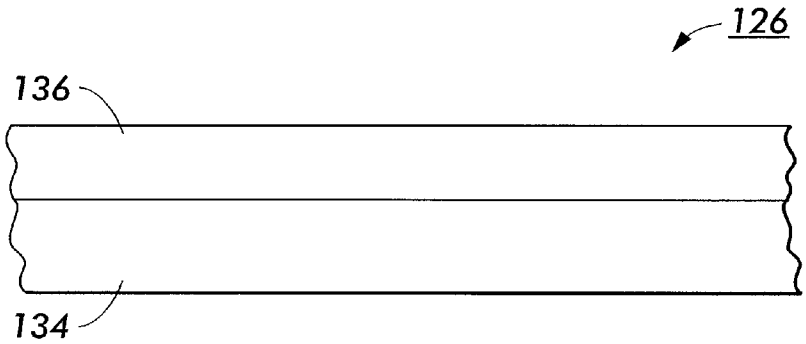
FIG. 4 is a side view of a fuser roll according to this invention.

FIG. 4 illustrates a portion of the fuser belt 126 according to this invention. The fuser belt 126 comprises a substrate 134 and an outer layer 136 formed over the substrate 134.

The fuser belt 126 can optionally also include an adhesive layer, cushion layer, or other suitable layer positioned between the substrate 134 and the outer layer 136.

Furthermore, in some embodiments, one or more optional layers can be formed over the outer layer 136. In such embodiments, the optional layers are referred to as outermost layers.

This invention provides fuser members having enhanced thermal conductivity properties. This invention also provides methods of making the fuser members.

As described above and shown in FIGS. 1–4, fuser members according to this invention can have different configurations and sizes. For example, fuser members can be formed as fuser rolls 26 and fuser belts 126. However, the term "fuser member" as used herein also refers to other different configurations, such as films, sheets and the like; donor members, including donor rolls, belts, films, sheets and the like; pressure members, including pressure rolls, belts, films, sheets and the like; and other members useful in fusing systems of electrostatographic imaging apparatus. The fuser members of this invention can be used in various different machines and their use is not limited to those embodiments depicted and described herein.

Substrates of fuser members according to this invention can have various configurations, including rolls, belts, flat surfaces, sheets, films, or any other suitable shape used in the fixing of toner images to a suitable copy substrate. The substrates can comprise any suitable metallic material, such as aluminum, anodized aluminum, steels including stainless steels, nickel, copper and the like. The substrates can also be formed of non-metallic materials, or mixtures of metallic and non-metallic materials. For example, the substrates can be formed of plastic materials having suitable rigidity and structural integrity, as well as being capable of being coated with materials comprising the outer layer of the fuser members.

For example, in some embodiments, the substrate is configured as a cylindrical sleeve, as shown in FIGS. 1 and 2. In exemplary embodiments, metallic substrates can be degreased with a solvent and cleaned with an abrasive cleaner prior to being primed with a primer, such as Dow Corning 1200. The primer may be applied, for example, by spraying, brushing, dipping or the like. The substrate can then be dried under ambient conditions and and/or baked at a suitable elevated temperature. The outer layer is applied over the substrate.

As shown in FIGS. 3 and 4, in embodiments, the substrate 134 can be a sheet and the fuser member can be a fuser belt 134.

Fuser members according to this invention comprise an outer layer having enhanced thermal conductivity properties. In embodiments, the outer layer has improved thermal conductivity in the thickness direction of the fuser members. For fuser rolls, the thickness direction is the radial direction of the fuser roll. For fuser members in the form of belts, sheets and other like configurations, improved thermal conductivity is also provided in the thickness of the outer layer.

Thermal conductivity is improved in the thickness direction in all embodiments of the fuser members. In some embodiments, longitudinal and/or tangential thermal conductivity is also enhanced. In other embodiments, longitudinal and/or tangential thermal conductivity may not also be enhanced.

As discussed in greater detail below, filler material included in the outer layer of fuser members according to this invention can have various different shapes. The shape of the filler material particles determines the amount of differential thermal conductivity in the thickness direction as compared to longitudinal and/or tangential directions of the outer layer. The filler material has a higher thermal conductivity than elastomers that are used to form the outer layer as described below.

Figure 5:
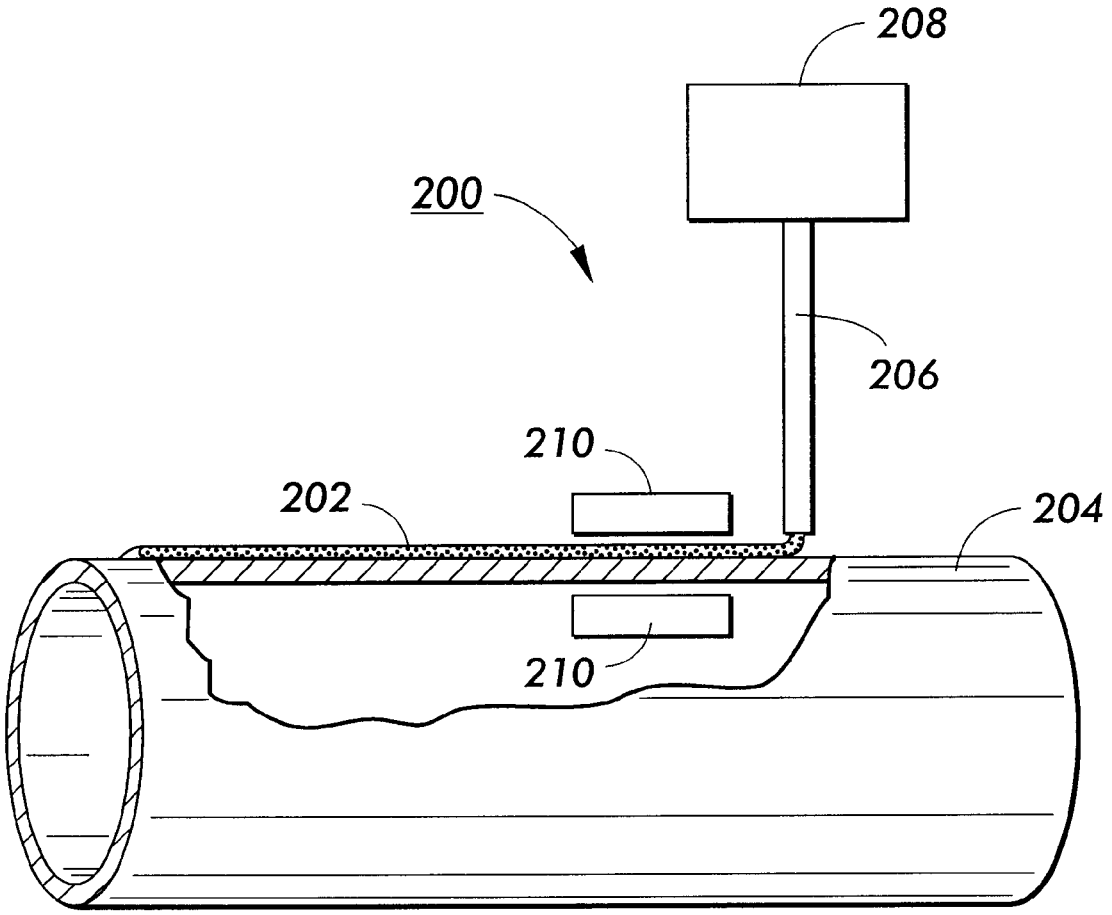
FIG. 5 is a schematic illustration of an apparatus for forming fuser members according to exemplary embodiments of processes according to this invention.

FIG. 5 schematically illustrates an apparatus 200 suitable for forming fuser members according to exemplary embodiments of processes according to this invention. The apparatus 200 forms a liquid coating 202 on a substrate 204. The coating 202 solidifies to form an outer layer on the substrate 204. For example, the substrate 204 can be a hollow cylinder, such as shown in FIG. 2, to form fuser rolls according to embodiments of this invention.

The apparatus 200 includes a coating device 206 that applies the liquid coating 202 material onto the substrate 204. The liquid coating 202 is supplied to the coating device 206 from a coating source 208 in which the coating is formulated or stored. The coating device 206 can be any suitable device for applying the liquid coating 202 on the substrate 204. For example, the coating device 206 can apply the coating 202 on the substrate 204 by flow coating, painting, spraying, or any other suitable process that can deliver and apply a coating layer with sufficiently low viscosity to allow the filler material to orient under the influence of the magnetic field.

Figure 6:
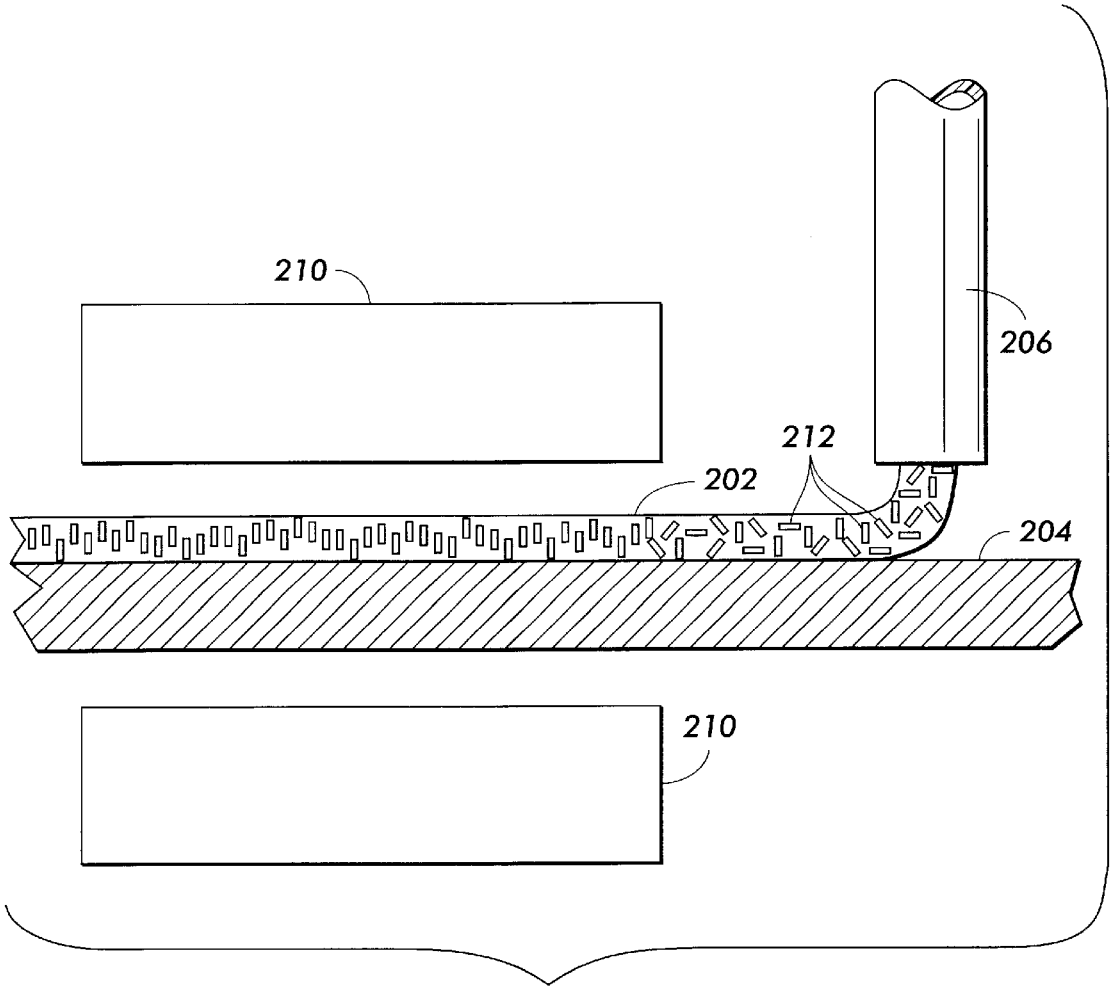
FIG. 6 illustrates the orientation of filler material in the outer layer of an exemplary embodiment of a fuser member according to this invention.

During the application of the coating material onto the substrate 204 to form the coating 202, the coating device 206 and magnets 210 are moved in unison in a selected direction relative to the substrate 204. The substrate 204 is typically maintained stationary during the coating process. However, in embodiments, the coating device 206 and magnets 210 can remain stationary and the substrate 204 can be moved, or both components can be moved, as desired. The magnets 210 generate a magnetic field having an orientation that causes filler material in the coating material to be oriented in the coating 202 at an orientation that is dependent on the magnetic field. As shown in FIG. 6, the filler material 212 in the coating 202 that is most recently applied by the coating device 206 and is spaced from the magnets 210 is randomly oriented in the coating 202. The filler material 212 in the coating 202 that is between the magnets 210 is substantially more oriented. That is, the filler material 212 between the magnets 210 is caused to be substantially more anisotropically oriented by the magnetic field.

The degree of orientation of the filler material 212 in the coating 202 (i.e., the percentage of filler material 212 in the coating 202 that is oriented within some angular range) is influenced by the magnetic flux of the magnets 210. The magnetic flux that is suitable for a given coating 202 is dependent on the viscosity of the coating and the desired degree of orientation of the filler material 212 in the coating.

In addition, in embodiments, the magnetic flux can be applied to the coating 202 more than once, if desired, to further affect the orientation of the filler material 212 in the coating 202.

In processes according to this invention, the magnetic field is applied to the coating 202 before the coating becomes cured. The coating is applied in the liquid state and is cured, such as by irradiating or by heating the coating 202 to an elevated temperature, to solidify the coating 202. The curing temperature that is used is dependent on the composition of the coating 202. Curing is performed subsequent to the application of the coating 202 and the orientation of the filler material 212 in the coating 202. Once the filler material 212 is oriented to the desired orientation, there is no positional or time limit for maintaining the orientation. The orientation is retained as long as the filler material 212 is not subjected to another magnetic field that changes the orientation. The orientation of the filler material 212 in the coating 202 is substantially retained in the orientation produced by the magnets 210 following the curing of the coating 202.

The filler material is preferably oriented in the thickness direction of the outer layer to enhance thermal conductivity in the thickness direction. As explained above, the thickness direction is the radial direction in fuser rolls and like configurations. Orienting the filler material in the thickness direction as shown in FIG. 6, increases the surface area of filler material that is oriented in the direction of heat flow in the fuser member. During normal fusing processes, heat flows outward from the substrate toward the outer surface of the outer layer of the fuser member, so as to fuse toner to a copy substrate. In fuser rolls, this heat flow is in the radial direction. In fuser members in the form of a belt or sheet, the heat flow direction is outward from the substrate to the outer surface of the outer layer, which is the thickness direction.

Orienting the filler material in the thickness direction of the outer layer of fuser members provides increased thermal conductivity by increasing heat flow outwardly from the heating member to the outer surface of the outer layer of the fuser member. Therefore, heat is conducted more efficiently in the thickness direction of fuser members. This increased heat conduction decreases the substrate temperature for an equivalent amount of heat inpurt to the substrate, according to the following equation:

$Q=K\cdot A\cdot \Delta T$, where;

$Q$=the amount of heat input to substrate, $K$=thermal conductivity of outer layer, $\Delta$=circumferential area of substrate, and $\Delta T$=temperature difference between the substrate interface and the temperature at the outer surface of the outer layer.

According to the above equation, as thermal conductivity of the outer layer increases, while heat flow and the temperature of the outer surface of the outer layer are held constant, the substrate temperature decreases.

The service life of fuser members according to this invention is enhanced by lowering the operating temperature, which is achieved by increasing thermal conductivity in the thickness direction.

In addition, the abrasion resistance of the outer layer can be enhanced by the addition of the filler material to the elastomer. Increasing the abrasion resistance of the outer layer enhances the service life of fuser members. Improvements of abrasion resistance of from about 5% to at least about 20% can be achieved.

Also, by using oriented filler material, less filler material needs to be contained in the outer layer of fuser members according to this invention in order to increase the thermal conductivity of the outer layer to the desired level. Reducing the amount of filler in the outer layer provides important advantages with respect to the performance of the fuser members. Particularly, release performance degrades as the filler material content in the outer layer of the fuser member increases. Accordingly, by reducing the filler material content, suitable release performance can be achieved in the fuser members according to this invention.

Another advantage of reducing the filler material content in the outer layer of the donor members according to this invention is that the hardness of the outer layer has a suitable value. That is, in general, increasing the amount of filler material in the outer layer increases the hardness of the outer layer. However, in fuser members according to this invention, the filler material is not added to the outer layer for the purpose of increasing the hardness of the outer layer. Rather, a more important reason for adding the filler material is to increase thermal conductivity of the outer layer of fuser members. Accordingly, by reducing the content of the filler material that needs to be added in the outer layer to achieve desired thermal conductivity, the hardness of the outer layer is not also increased to an undesirably high value by the filler material. In some embodiments of the fuser members, suitable hardness values in the range of from about 30 to about 85 Shore A can be achieved.

In fuser members according to embodiments of this invention, thermal conductivity in the longitudinal direction of the fuser member is not necessarily increased by the filler material. However, at least for fuser rolls, the substrate itself has sufficient conductivity to provide sufficient longitudinal heat distribution.

In embodiments of the fuser members in which the fuser member is a fuser belt, sheet or like configuration, the surface of the fuser member comes into contact with a heating element, such as a heat shoe, as the fuser member enters the fusing nip. The heating element has sufficient thermal conductivity to uniformly supply heat longitudinally to the entire fuser member surface.

Exemplary suitable elastomers for forming the outer layer of fuser members according to this invention include fluoroelastomers. Suitable fluoroelastomers are described, for example, in U.S. Pat. Nos. 4,257,699; 5,017,432; 5,061,965; 5,166,031; 5,281,506; 5,366,772 and 5,370,931, each incorporated herein by reference in its entirety.

These fluoroelastomers, particularly from the class of copolymers, terpolymers, and tetrapolyiners of vinylidenefluoride, hexafluoropropylene and tetrafluoroethylene and a possible cure site monomer, are known commercially under various designations as VITON A®, VITON E®, VITON E6C®, VITON E430®, VITON 910®, VITON GH® VITON GF®, VITON E45®, VITON A201C®, and VITON B50®. The VITON® designation is a Trademark of E.I. DuPont de Nemours, Inc. Other commercially available materials include FLUOREL 2170®, FLUOREL 2174®, FLUOREL 2176®, FLUOREL 2177®, FLUOREL 2123®, and, FLUOREL LVS76®, FLUOREL® being a Trademark of 3M Company. Additional commercially available materials include AFLAS™ a poly (propylene-tetrafluoroethylene) and FLUOREL II® (LII900) a poly(propylene-tetrafluoroethylenevinylidenefluoride) elastomer both also available from 3M Company, as well as the TECNOFLONS® identified as FOR-60KIR®, FOR-LHF®, NM® FOR-THF®, FOR-TFS®, TH®, TN505® available from Montedison Specialty Chemical Company.

In some embodiments, the fluoroelastomer has a relatively low quantity of vinylidenefluoride, such as in VITON GF®, available from E.I. DuPont de Nemours, Inc. The VITON GF® has 35 weight percent of vinylidenefluoride, 34 weight percent of hexafluoropropylene and 29 weight percent of tetrafluoroethylene with 2 weight percent cure site monomer. The cure site monomer can be those available from DuPont such as 4-bromoperfluorobutene-1,1,1-dihydro-4-bromoperfluorobutene-1,3-bromoperfluoropropene-1,1,1-dihydro-3-bromoper$uoropropene-1, or any other suitable, known, commercially available cure site monomer. The fluorine content of the VITON GF® is about 70 weight percent by total weight of fluoroelastomer.

In other embodiments, the fluoroelastomer has a relatively low fluorine content such as VITON A201C, which is a polymer of vinylidene fluoride and hexafluoropropylene, having about 65 weight percent fluorine content. This copolymer is compounded with crosslinkers and phosphonium compounds used as accelerators.

In some embodiments, the fluoroelastomer has a relatively high fluorine content of from about 65 to about 71, preferably from about 69 to about 70 weight percent, and more preferably about 70 percent fluorine by weight of total fluoroelastomer.

Other suitable fluoroelastomers include fluoroelastomer composite materials that are hybrid polymers comprising at least two distinguishing polymer systems, blocks or monomer segments, one monomer segment (hereinafter referred to as a "first monomer segment"), of which possesses a high wear resistance and high toughness, and the other monomer segment (hereinafter referred to as a "second monomer segment"), of which possesses low surface energy. The composite materials described herein are hybrid or copolymer compositions comprising substantially uniform, integral, interpenetrating networks of a first monomer segment and a second monomer segment. In some embodiments, optionally a third grafted segment, wherein both the structure and the composition of the segment networks are substantially uniform when viewed through different slices of the fuser member. Interpenetrating network, in embodiments, refers to the addition polymerization matrix where the polymer strands of the first monomer segment and second monomer segment, and optional third grafted segment, are intertwined in one another. A copolymer composition, in embodiments, is comprised of a first monomer segment and second monomer segment, and an optional third grafted segment, wherein the monomer segments are randomly arranged into a long chain molecule. Examples of polymers suitable for use as the first monomer segment, or tough monomer segment, include, for example polyamides, polyimides, polysulfones, and fluoroelastomers.

Examples of the second monomer segment polymers, or low surface energy monomer segments include polyorganosiloxanes, and include intermediates, which form inorganic networks. An intermediate is a precursor to inorganic oxide networks present in polymers described herein. This precursor goes through hydrolysis and condensation followed by the addition reactions to form desired network configurations of, for example, networks of metal oxides such as titanium oxide, silicon oxide, zirconium oxide and the like; networks of metal halides; and networks of metal hydroxides. Examples of intermediates include metal alkoxides, metal halides, metal hydroxides, and a polyorganosiloxane as defined above. The preferred intermediates are alkoxides, and specifically preferred are tetraethoxy orthosilicate for silicon oxide network and titanium isobutoxide for titanium oxide network.

In embodiments, a third low surface energy monomer segment is a grafted monomer segment and, in preferred embodiments, is a polyorganosiloxane as described above. In these preferred embodiments, it is particularly preferred that the second monomer segment is an intermediate to a network of metal oxide. Preferred intermediates include tetraethoxy orthosilicate for silicon oxide network and titanium isobutoxide for titanium oxide network.

Examples of suitable polymer composites include volume grafted elastomers, titamers, grafted titamers, ceramers, grafted ceramers, polyamide polyorganosiloxane copolymers, polyimide polyorganosiloxane copolymers, polyester polyorganosiloxane copolymers, polysulfone polyorganosiloxane copolymers, and the like. Titamers and grafted titamers are disclosed in U.S. Pat. No. 5,486,987; ceramers and grafted ceramers are disclosed in U.S. Pat. No. 5,337,129; and volume grafted fluoroelastomers are disclosed in U.S. Pat. No. 5,366,772. Each of these patents are incorporated herein by reference in their entirety.

Other elastomers suitable for use in this invention include silicone rubbers. Suitable silicone rubbers include room temperature vulcanization (RTV) silicone rubbers; high temperature vulcanization (HTV) silicone rubbers and low temperature vulcanization (LTV) silicone rubbers. These rubbers are known and readily available commercially such as SILASTIC® 735 black RTV and SILASTIC® 732 RTV, both from Dow Coming; and 106 RTV Silicone Rubber and 90 RTV Silicone Rubber, both from General Electric. Further examples of silicone materials include Dow Corning SILASTIC® 590 and 591, Sylgard 182, and Dow Corning 806A Resin. Other preferred silicone materials include fluorosilicones such as nonylfluorohexyl and fluorosiloxanes such as DC94003 and Q5-8601, both available from Dow Coming. Silicone conformable coatings such as X3-6765 are available from Dow Coming. Other suitable silicone materials include the siloxanes (preferably polydimethylsiloxanes) such as, for example, fluorosilicones, dimethylsilicones, liquid silicone rubbers, such as vinyl crosslinked heat curable rubbers or silanol room temperature crosslinked materials, and the like. Suitable silicone rubbers are available also from Wacker Silicones.

To form liquid coatings, such as the coating 202 shown in FIGS. 5 and 6, a solvent is preferably combined with the elastomer and filler material to achieve the desired viscosity for the coating process that is used.

The filler material included in outer layers of fuser members according to this invention is preferably dimensionally anisotropic. That is, a dimensionally anisotropic filler material has a shape and configuration such that the thickness is significantly smaller than the perimeter of the filler material. In other words, anisotropic filler material has a major axis and a minor axis. The major axis is larger than the minor axis, but the dimension in the third direction is distinctly smaller than in the other two directions. The dimensional anisotropy of the filler material can be characterized by its aspect ratio. The aspect ratio can be defined as the ratio of the largest dimension to the smallest dimension of the filler material (i.e., aspect ratio=largest dimension/smallest dimension). In embodiments, the aspect ratio of the filler material is preferably at least three and, more preferably, is at least seven.

In embodiments, either the major axis or the minor axis of the filler material is substantially parallel to a thickness direction of the fuser member. For example, the major axis or minor axis can extend is the radial direction for fuser rolls. In some preferred embodiments, the filler material is platelet shaped. Other suitable shapes of the filler material include, for example, flake, acicular, cylindrical, ligamental, fibrous and ellipsoidal.

The filler material can comprise particles of at least one ferromagnetic material (i.e., a strongly magnetic material); at least one paramagnetic material (materials that are less strongly attracted to strong magnetic fields than ferromagnetic materials); particles of alloys comprising at least one ferromagnetic material and/or paramagnetic material; mixtures of ferromagnetic and paramagnetic materials; or mixtures of ferromagnetic and/or paramagnetic materials and non-magnetic materials. Suitable exemplary ferromagnetic materials for use as the filler material of the outer layer 36, 136 of fuser members include iron, nickel and cobalt.

The filler material can also comprise materials other than metals and metal alloys. For example, the filler material can comprise graphite, metal oxides such as aluminum oxide, zinc oxide, iron oxide, molybdenum disulfide, and mixtures thereof. As stated above, more than one filler material composition and/or configuration can be included in the outer layer of fuser members according to this invention.

In embodiments, the filler material can have anisotropic magnetic properties. That is, such filler materials have superior magnetic properties along a certain preferred axis or dimension. For example, for filler materials having a high aspect ratio, such as those having a platelet shape, the magnetic properties of the filler material can be made superior along the major axis of the platelets by suitable processing of the filler material.

The filler material is added in the outer layer in a sufficient amount to achieve the desired thermal conductivity. In embodiments, the filler material is added in a total amount of from about 10 to about 40 volume %, and preferably from about 10 to about 30 volume %, based on the total volume of the outer layer. Generally, the thermal conductivity of the outer layer increases as the content of the filler material increases in the outer layer. However, as stated above, increasing the content of the filler material also increases the hardness of the outer layer. Accordingly, the content of the filler material is selected to achieve a desired thermal conductivity and also suitable hardness.

In some embodiments, both the degree of orientation of the filler material and the thermal conductivity of the outer layer can be enhanced by the optional addition of a fluorocarbon powder or perfluoroether liquids to the outer layer, in addition to an anisotropic filler. Examples of fluorocarbon powders include perfluoropolymers, such as fluorinated ethylenepropylene copolymer (FEP), polytetrafluoroethylene (PTFE), perfluoroalkoxy copolymers (PFA), for example, tetrafiuoroethylene perfluoroalkylvinylether copolymers (PFA TEFLON®), tetrafluoroethylene hexafluoropropylene copolymers, tetrafluoroethylene ethylene copolymers, tetrafluoroethylene-hexafluoropropylene-perfluoroalkylvinylether copolymer powders, and mixtures thereof. Preferably, the fluorocarbon powder filler is added in a total amount of from about 1 to about 15 parts, preferably from about 2 to about 10 parts, and more preferably from about 4 to about 7 parts per 100 of the elastomer forming the outer layer. Examples of perfluoroether liquids include KRYTOX® available from DuPont.

The particle size of the filler material and the optional fluorocarbon powder is preferably not too small as to harden the outer layer excessively or negatively affect the strength properties of the outer layer. In addition, the filler material and optional fluorocarbon powder are sized to be selectively orientable in the radial direction of the outer layer. In general, although not necessarily preferred, the filler material can have a larger size as the thickness of the outer layer increases and still be sufficiently orientable in the outer layer. Typically, the filler material has a particle size or mean diameter, as determined by standard methods, of from about 0.01 to about 40 microns, and preferably about 1 to about 10 microns.

Typically, fluorocarbon powder filler has a particle size or mean diameter, as determined by standard methods, of from about 3 to about 30 $\mu$m, and preferably from about 8 to about 15 $\mu$m.

The orientation of the filler material in the outer layer affects the thermal conductivity of the outer layer by affecting the surface area of the filler material that is oriented in certain orientations. By orienting the fillers in the thickness direction of fuser members, the thermal conductivity is increased by from about 5% to about 100%, preferably from about 20% to about 90%, and more preferably from about 40% to about 90%.

According to this invention, it is desirable that the percentage of the filler material in the outer layer that is oriented in the desired orientation is high. By increasing this percentage, the heat flow in the desired orientation of the filler material is increased. Typically, from about 20% to about 100% of the filler material in the outer layer has the desired orientation, preferably from about 50% to about 95%, and more preferably from about 85% to about 95%.

In embodiments, other materials including adjuvants and fillers may optionally be incorporated in the outer layer of the fuser members provided that such other materials do not adversely affect the integrity of the elastomer material. Such fillers typically use in the formation of elastomers include coloring agents, reinforcing fillers and processing aids. Oxides such as magnesium oxide and hydroxides such as calcium hydroxide are suitable for use in curing many fluoroelastomers. Other metal oxides, such as cupric oxide and zinc oxide can be used to improve release. Other suitable optional fillers include carbon black, aluminum oxide, indium tin oxide, antimony tin oxide and boron nitride.

If the fuser member is in the form of a fuser roll, the outer layer can have a thickness of from about 2 μm to about 9 mm. Preferably, the outer layer has a thickness of from about 20 μm to about 9 mm.

In embodiments in which the fuser member is a pressure roll, the coating thickness range is typically from about 2 μm to about 9 mm. Preferably, the outer layer has a thickness of from 20 μm to about 9 mm.

In embodiments in which the fuser member is a fuser belt, the outer layer typically has a thickness of from about 2 μm to about 6 mm. Preferably, the outer layer thickness if from about 20 μm to about 4 mm.

It is advantageous to form outer layers of fuser members according to this invention as thin layers. Thin layers are advantageous because they generally are more conductive than thicker layers. The elastomer forming the outer layer is typically less thermally conductive than the underlying layer, which is the substrate or some layer formed between the substrate and outer layer. As stated above, the substrate can be composed of a metal. In such embodiments, the thermal conductivity of the substrate is greater than the thermal conductivity of the outer layer. By reducing the thickness of the outer layer, the barrier to heat conduction to the outer surface of the outer layer is reduced.

Release agents can be used in combination with elastomers forming the outer layer of fuser members according to this invention. Preferred polymeric fluid release agents comprise molecules having functional groups that interact with the filler material particles and also with the elastomer itself to form a layer of fluid release agent, which results in an interfacial barrier at the surface of the fuser member, while leaving a non-reacted low surface energy release fluid as an outer release film. Suitable release agents include polydimethylsiloxane fusing oils having amino, mercapto, and other functionality for fluoroelastomer compositions. For silicone based compositions, a nonfunctional oil may also be used. The release agent may further comprise non-functional oil as diluent.

The following Examples further define and describe exemplary embodiments of this invention.

EXAMPLE

Samples 1–9 are formed by mechanically blending silicone elastomer containing different amounts of iron oxide filler material and pouring the blended material into an aluminum mold. Samples 2, 4, 6 and 8 and the aluminum mold are passed through a magnetic field induced by suspended permanent magnets. Samples 1, 3, 5 and 7 are not passed through the magnetic field. Samples 1–9 are heated to cure the blended elastomer. The samples have an average thickness of about 0.2 mm.

The test results are shown in the following TABLE.

TABLE

| Sample | Volume % Filler Material | Thermal Conductivity (W/m · K) |
|---|---|---|
| 1 | 15 (unoriented) | 0.224 |
| 2 | 15 (oriented) | 0.244 |
| 3 | 20 (unoriented) | 0.239 |
| 4 | 20 (oriented) | 0.261 |
| 5 | 25 (unoriented) | 0.297 |
| 6 | 25 (oriented) | 0.321 |

TABLE-continued

| Sample | Volume % Filler Material | Thermal Conductivity (W/m · K) |
|---|---|---|
| 7 | 30 (unoriented) | 0.331 |
| 8 | 30 (oriented) | 0.414 |

In the TABLE, the term "unoriented" means that the filler material is not oriented by the application of a magnetic field. The term "oriented" means that the filler material is oriented by the application of a magnetic field. For Samples 2, 4, 6 and 8, the percentage of the filler material that is oriented by the magnetic field is about 50%.

The samples are tested to determine their thermal conductivity at a temperature of about 350° F. using a Dynatech-Model C-Matic TCHM-DV. The thermal conductivity results establish that applying a magnetic field to the coating materials significantly improves the thermal conductivity of the coatings. In addition, processes according to this invention are simple to perform.

Therefore, fuser members according to this invention comprise elastomers and filler materials. The fuser members have increased thermal conductivity, which decreases the temperature needed to heat the fuser member. In addition, the increased thermal conductivity of the fuser member decreases heat-up or warm-up time, resulting in increased fusing speed. In addition, the fuser members have enhanced thermal conductivity and also suitable hardness.

While the invention has been described in conjunction with the specific embodiments described above, it is evident that many alternatives, modifications and variations are apparent to those skilled in the art. Accordingly, embodiments of the invention as set forth above are intended to be illustrative and not limiting. Various changes can be made without departing from the spirit and scope of the invention.

What is claimed is:

1. A fuser member, comprising:

a substrate; and an outer layer over the substrate, the outer layer having a thickness, the outer layer comprising an elastomer and a filler material dispersed in the elastomer, the filler comprising at least one ferromagnetic or paramagnetic metal or metal alloy;

wherein the filler material is anisotropically orientated in the outer layer.

2. The fuser member of claim 1, wherein the filler material comprises particles having an aspect ratio of at least about 3.

3. The fuser member of claim 1, wherein the outer layer comprises from about 10 to about 40 volume % of the filler material.

4. The fuser member of claim 3, wherein the outer layer comprises from about 10 to about 30 volume % of the filler material.

5. The fuser member of claim 1, wherein the fuser member is a fuser roll.

6. The fuser member of claim 5, wherein the outer layer (i) has a thickness of from about 2 μm to about 9 mm, and (ii) comprises from about 10 to about 40 volume % of the filler material.

7. The fuser member of claim 1, wherein the fuser member is a fuser belt.

8. The fuser member of claim 7, wherein the outer layer (i) has a thickness of from about 2 μm to about 6 mm, and (ii) comprises from about 10 to about 40 volume % of the filler material.

9. The fuser member of claim 1, wherein the filler material has a largest dimension of from about 2 $\mu$m to about 10 $\mu$m.

10. The fuser member of claim 1, wherein the filler material is a metal or metal alloy selected from the group consisting of iron, nickel and cobalt.

11. An imaging member comprising at least one fuser member according to claim 1.

12. The imaging member of claim 11, wherein the fuser member is a fuser roll.

13. The imaging member of claim 11, wherein the fuser member is a fuser belt.

14. A method of forming a fuser member, comprising:

applying a liquid coating material over a substrate, the coating material comprising an elastomer and a filler material, the filler material comprising at least one material selected from the group consisting of ferromagnetic materials and paramagnetic materials;

applying a magnetic field to the coating material so as to orient the filler material in a selected orientation in the coating material; and curing the coating material to form an outer layer over the substrate, the outer layer having a thickness, wherein the filler material is orientated substantially in the selected orientation in the outer layer.

15. The method of claim 14, wherein the filler material comprises particles having an aspect ratio of at least about 3.

16. The method of claim 14, wherein he outer layer comprises from about 10 to about 40 volume % of the filler material.

17. The method of claim 16, wherein the outer layer comprises from about 10 to about 30 volume % of the filler material.

18. The method of claim 14, wherein the fuser member is a fuser roll.

19. The method of claim 14, wherein the outer layer (i) has a thickness of from about 2 $\mu$m to about 9 mm, and (ii) comprises from about 10 to about 40 volume % of the filler material.

20. The method of claim 14, wherein the fuser member is a fuser belt.

21. The method of claim 20, wherein the outer layer (i) has a thickness of from about 2 $\mu$m to about 6 mm, and (ii) comprises from about 10 to about 40volume % of the filler material.

22. The method of claim 14, wherein the filler material has a largest dimension of from about 2 $\mu$m to about 10 $\mu$m.

23. The method of claim 14, wherein the filler material consists essentially of ferromagnetic material.

24. A fuser member, comprising:

a substrate; and an outer layer over the substrate, the outer layer having a thickness, the outer layer comprising an elastomer and a filler material dispersed in the elastomer, the filler material comprising at least one ferromagnetic or paramagnetic metal or metal alloy;

wherein the filler material is anisotropically oriented in the outer layer, wherein the fuser member is formed by:

applying a liquid coating material over the substrate, wherein the coating material comprises the elastomer and filler material;

applying a magnetic field to the coating material so as to anisotropically orient the filler material in the coating material; and curing the coating material to form the outer layer over the substrate.

* * * * *